US012089706B1

(12) United States Patent
Tan et al.

(10) Patent No.: US 12,089,706 B1
(45) Date of Patent: Sep. 17, 2024

(54) DETACHABLE PHONE WALLET

(71) Applicant: Fosmon IP Holding Company, LLC, Woodbury, MN (US)

(72) Inventors: Feon Tan, Woodbury, MN (US); Shung Yat Loh, Woodbury, MN (US); Ho Yin Lee, Woodbury, MN (US); Ping Hay Heun, Woodbury, MN (US); Chee Shyong Wong, Woodbury, MN (US)

( * ) Notice: Subject to any disclaimer, the term of this patent is extended or adjusted under 35 U.S.C. 154(b) by 267 days.

(21) Appl. No.: 17/712,581

(22) Filed: Apr. 4, 2022

(51) Int. Cl.
*A45C 11/18* (2006.01)
*A45C 11/00* (2006.01)
*A45C 13/00* (2006.01)

(52) U.S. Cl.
CPC ..... *A45C 11/182* (2013.01); *A45C 13/005* (2013.01); *A45C 2011/002* (2013.01); *A45C 2200/15* (2013.01)

(58) Field of Classification Search
CPC ..... A45C 11/182; A45C 13/005; A45C 2011/002; A45C 2200/15; A45C 2011/003
See application file for complete search history.

(56) References Cited

U.S. PATENT DOCUMENTS

| | | | | |
|---|---|---|---|---|
| 7,555,325 | B2 | 6/2009 | Goros | |
| 8,047,364 | B2 | 11/2011 | Longinotti-Buitoni | |
| 8,381,904 | B1 | 2/2013 | Longinotti-Buitoni | |
| 8,418,852 | B2 | 4/2013 | Ziemba | |
| 8,504,127 | B2 | 8/2013 | Altschul et al. | |
| 8,726,952 | B2 | 5/2014 | Jambunathan et al. | |
| 8,757,376 | B2 | 6/2014 | Azzoni | |
| 8,759,675 | B2 | 6/2014 | Rajeswaran et al. | |
| 8,942,773 | B2 | 1/2015 | Wu | |
| 8,967,377 | B2 | 3/2015 | Lebauer | |
| 8,989,826 | B1 | 3/2015 | Connolly | |
| 9,004,275 | B2 | 4/2015 | Lee | |
| 9,049,283 | B1 | 6/2015 | Kim | |
| 9,281,858 | B2 | 3/2016 | Fathollahi | |
| 9,768,822 | B1 | 9/2017 | Loh et al. | |
| D831,630 | S | 10/2018 | Altschul et al. | |
| 10,164,468 | B2 * | 12/2018 | Fitzgerald | H02J 7/0042 |
| 10,236,928 | B2 | 3/2019 | Tu et al. | |
| 10,506,857 | B2 | 12/2019 | Altschul et al. | |
| 10,511,342 | B1 * | 12/2019 | Chung | H04M 1/0202 |
| 11,083,264 | B2 | 8/2021 | Komios | |
| 2010/0072334 | A1 | 3/2010 | Le Gette et al. | |
| 2011/0077061 | A1 | 3/2011 | Danze et al. | |
| 2011/0294542 | A1 | 12/2011 | Ray et al. | |
| 2012/0067751 | A1 * | 3/2012 | Mongan | A45C 11/00 206/216 |
| 2012/0147536 | A1 | 6/2012 | Sa | |
| 2013/0118923 | A1 * | 5/2013 | Longinotti-Buitoni | A45C 11/00 206/38 |
| 2013/0220847 | A1 | 8/2013 | Fisher et al. | |

(Continued)

*Primary Examiner* — Don M Anderson
*Assistant Examiner* — Justin Caudill
(74) *Attorney, Agent, or Firm* — Dietz Law Office, LLC

(57) ABSTRACT

A phone wallet that magnetically couples to an electronic device may also include a protective carrying case for the electronic device. The phone wallet includes a concealed storage compartment, wherein the concealed compartment may store credit cards, identification cards and other personal articles. The detachable phone wallet also includes an integrated stand that enables a user to prop the mobile device at a desired angle.

18 Claims, 20 Drawing Sheets

(56) References Cited

U.S. PATENT DOCUMENTS

| | | | | |
|---|---|---|---|---|
| 2013/0328825 | A1* | 12/2013 | Brown | G01B 7/30 345/174 |
| 2014/0016217 | A1 | 1/2014 | Rayner | |
| 2014/0066142 | A1 | 3/2014 | Gipson | |
| 2014/0066143 | A1 | 3/2014 | Choi | |
| 2014/0091689 | A1* | 4/2014 | Mishan | H04M 1/21 312/223.1 |
| 2014/0128132 | A1 | 5/2014 | Cox, III | |
| 2014/0263939 | A1 | 9/2014 | Rinner | |
| 2014/0378193 | A1 | 12/2014 | Biancamano et al. | |
| 2015/0011265 | A1 | 1/2015 | Walsh, Jr. | |
| 2015/0069099 | A1 | 3/2015 | Diebel et al. | |
| 2015/0129095 | A1 | 5/2015 | Marin | |
| 2015/0230570 | A1 | 8/2015 | Kim | |
| 2016/0014922 | A1 | 1/2016 | Banerjee et al. | |
| 2016/0206065 | A1* | 7/2016 | Ehrlich | A45C 1/06 |
| 2018/0191395 | A1* | 7/2018 | Chung | H04B 1/3888 |
| 2019/0125049 | A1* | 5/2019 | Komlos | A45C 11/321 |
| 2019/0296788 | A1* | 9/2019 | Zavala | A45C 11/321 |
| 2022/0045398 | A1* | 2/2022 | Havskjold | H01M 50/204 |
| 2022/0045527 | A1* | 2/2022 | Karanikos | H01F 27/366 |
| 2022/0087389 | A1* | 3/2022 | Wulff | H01F 7/02 |

* cited by examiner

DETACHABLE PHONE WALLET

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

The present invention relates generally to wallets that attach to electronic devices. More particularly, the present invention relates to a phone wallet that unobtrusively and easily detaches and reattaches to an electronic device while concealing an opening to the wallet and while providing a support stand when attached to the phone. The present invention further relates to a non-intrusive mobile phone protective case having a pocket adapted for receiving the detachable phone wallet therein. The phone wallet is easily removed to allowing for wireless charging of the mobile device without removing the casing.

BACKGROUND

Over the years features and functions of mobile electronic devices and accessories for those devices have progressed. By way of example, recent advances have been incorporated into mobile phones to allow the battery in the device to be charged wirelessly. However, mobile electronic devices, such as cellular phones, tablets and laptops often include an external housing that may shatter or sustain damage from an impact. The damage from impact may result in a cracked screen, scratches on a finished surface, and/or failed or malfunctioning electrical components. Complimentary casings have been provided to reduce potential damage from impact. However, in the past, these complimentary casings must be removed in order to charge the batteries in the phone wirelessly. Accordingly, there is a desire to provide a protective case that allows the phone batteries to be charged wirelessly without the need to remove the protective casing from the phone.

Further, although carrying devices such as purses or fanny packs have been used to both carry and protect the mobile devices, some users have preferred to eliminate the bulk of a purse or fanny pack while still carrying the phone and a small organizer of a few personal belongings such as ID's, cash, or credit cards. Having two small, uncontained items increases the chance that one is set down and forgotten or otherwise misplaced. Accordingly, there is a desire to couple the personal electronic device and small organizer together while also being able to quickly decouple the electronic device and organizer.

SUMMARY

Embodiments according to aspects of the present invention provide a detachable phone wallet that quickly magnetically couples and decouples with a smart phone. These embodiments further provide a phone wallet that has a hinged storage compartment cover that may be used as a stand when coupled to a phone. In certain embodiments according to aspects of the invention the detachable phone wallet fits within a pocket formed in a protective covering that protects the phone by encompasses the sides and back of the smart phone. The multi hinged panel or cavity may be utilized to conceal the storage compartment and may also be altered to prop up or stand the electronic device at a desired angle. A further aspect of the invention allows a wireless charger to be linked to phone through the pocket of the protective casing.

The detachable phone wallet in accordance with aspects of the present invention includes a rigid body having a cavity formed therein and a hinged panel that covers an open end of the cavity. The hinged panel has a first end portion fixed to an outer surface of the rigid body and a second free end portion that is adapted to extend over and cover the open end of the cavity. The cavity terminates in the rigid body at a base portion of the rigid body, thereby forming a second closed end of the cavity. The base portion includes a backing portion that forms an exterior of the rigid body. Alignment magnets are sandwiched between the base portion and backing portion of the closed end of the cavity of the rigid body. Those skilled in the art will appreciate that the base portion and backing portion may be constructed as layers attached to the remaining portion of the rigid body or may be manufactured integral with the rigid body. When manufactured integral with the rigid body the alignment magnets are embedded during the manufacture of the rigid body. Panel magnets are associated with either or both of the hinged panel and the rigid body to provide fixation of the hinged panel when covering the cavity. The hinged panel further includes a plurality of hinged folds.

In embodiments of the invention the detachable phone wallet may further include ferromagnetic metal strips associated with the hinged panel that attract to panel magnets positioned on the rigid body. Also, hinged folds may be defined by a plurality of hinged joints. The open end of the cavity may include flanges extending from the rigid body that provides additional support to the hinged panel when covering the cavity. Also, ramps may be formed on the cavity sidewalls to facilitate insertion and removal of credit and ID cards relative to the cavity. Additionally, the phone wallet may insert into a pocket formed in a protective casing. The casing has a pliable body and a rim extending outward from the pliable body, wherein the rim of the pliable body is adapted for engaging sides of an electronic device. Those skilled in the art will appreciate that the pliable quality is considered relative to the wallet's rigid body. Thus, the pliable body is considered pliable if it is able to be manipulated enough to slip over the sides of a phone and encase the phone sides.

In accordance with aspects of the invention, an embodiment of the invention includes a rigid body, a panel cover, alignment magnets, panel cover magnets, and a phone protective casing. The rigid body has a cavity formed therein such that the rigid body has an open end or open front and a closed end or closed back side. The closed end or back side of the rigid body is comprised of a base portion or layer and a backing portion or layer. The alignment magnets are sandwiched between the base portion and backing portion of the rigid body and the backing portion forms an exterior of the rigid body. The backing portion and base portion may be layers or films applied to the rigid body or may be integral with the rigid body. The hinge panel has a first end portion that is fixed to an outer surface of the rigid body and further has a second free end portion that is adapted to extend over and cover the open end of the cavity. The protective phone casing extends outward in the same plane as the back face of the rigid body and includes a rim extending orthogonally about a perimeter of the casing. The dimensions of the planar casing and rim are such so that sides of a phone may be encompassed, engaged, and encased by the rim. The protective casing further includes a pocket that is dimensioned and adapted to receive and couple the rigid body within the pocket.

In certain aspects of this embodiment of the invention the detachable phone wallet may further include metal strips associated with the hinged panel and magnets associated with the rigid body. In this manner the magnets may hold the hinge panel in place when the panel is covering the open cavity of the rigid body. The rigid body may further include flanges that block outer access to a portion of the cavity and provide support to the hinge panel. The protective casing may include one or more apertures extending through the casing that are dimensioned and positioned to allow access to control ports or other features of the mobile device. Those skilled in the art will appreciate that a variety of hinged stands or flaps and access opening configurations may be utilized in accordance with the present invention.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

The following description provides detail of various embodiments of the invention, one or more examples of which are set forth below. Each of these embodiments are provided by way of explanation of the invention, and not intended to be an undue limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

In an embodiment of the invention a slender and compact detachable phone wallet 10 is provided that minimizes the bulkiness and weight of a larger wallet and may also include a phone casing 84 that encompasses the back and sides of a mobile phone to offer impact protection and additional versatility. The detachable phone wallet 10 for a mobile electronic device 96 is configured to be user easily removed and reattached, allowing a user to wirelessly charge the phone battery without removing the casing from the phone.

Figure 1:
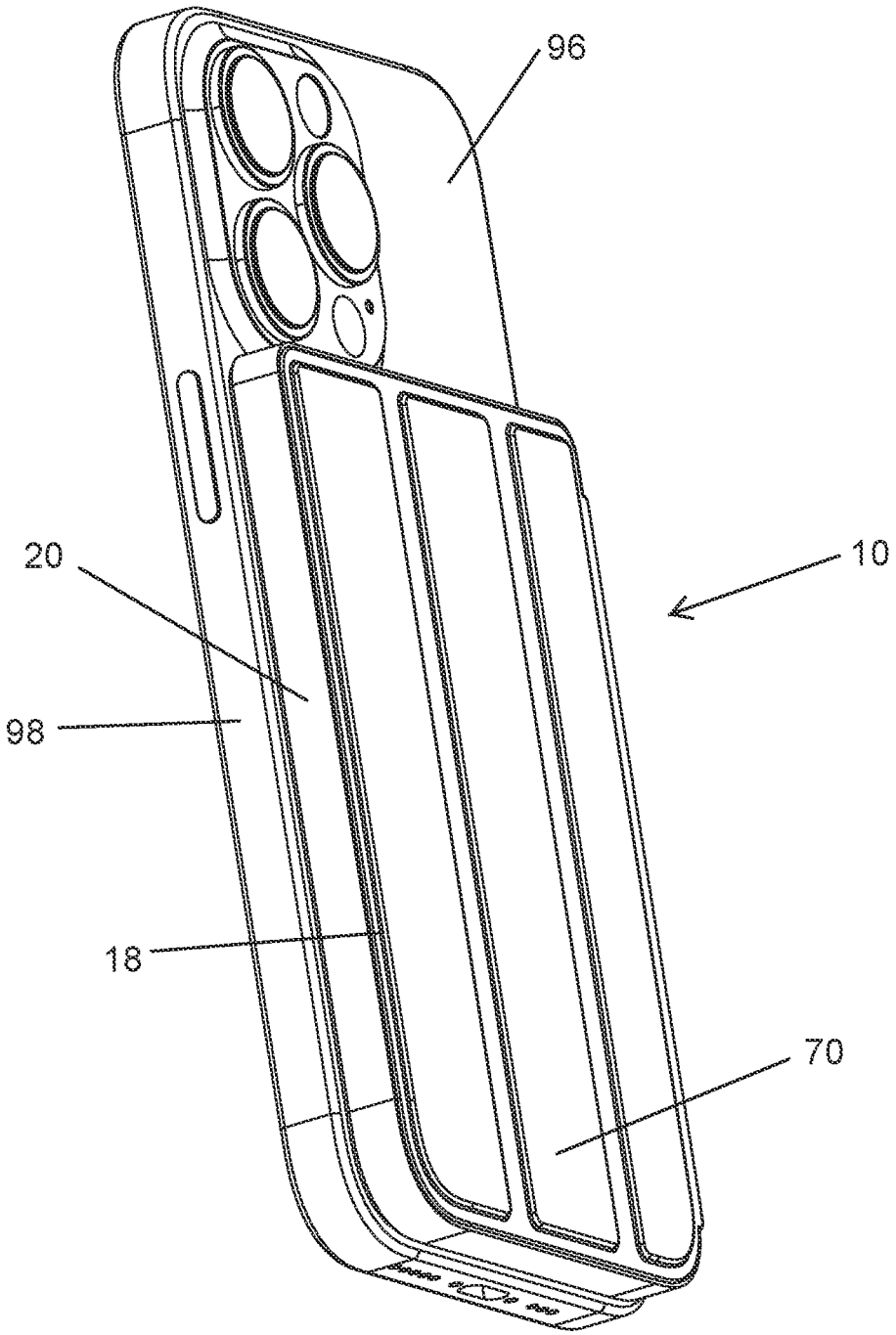
FIG. 1 is a front perspective view of a detachable phone wallet in accordance with the present invention shown magnetically coupled to an electronic device or smart phone.
Figure 2:
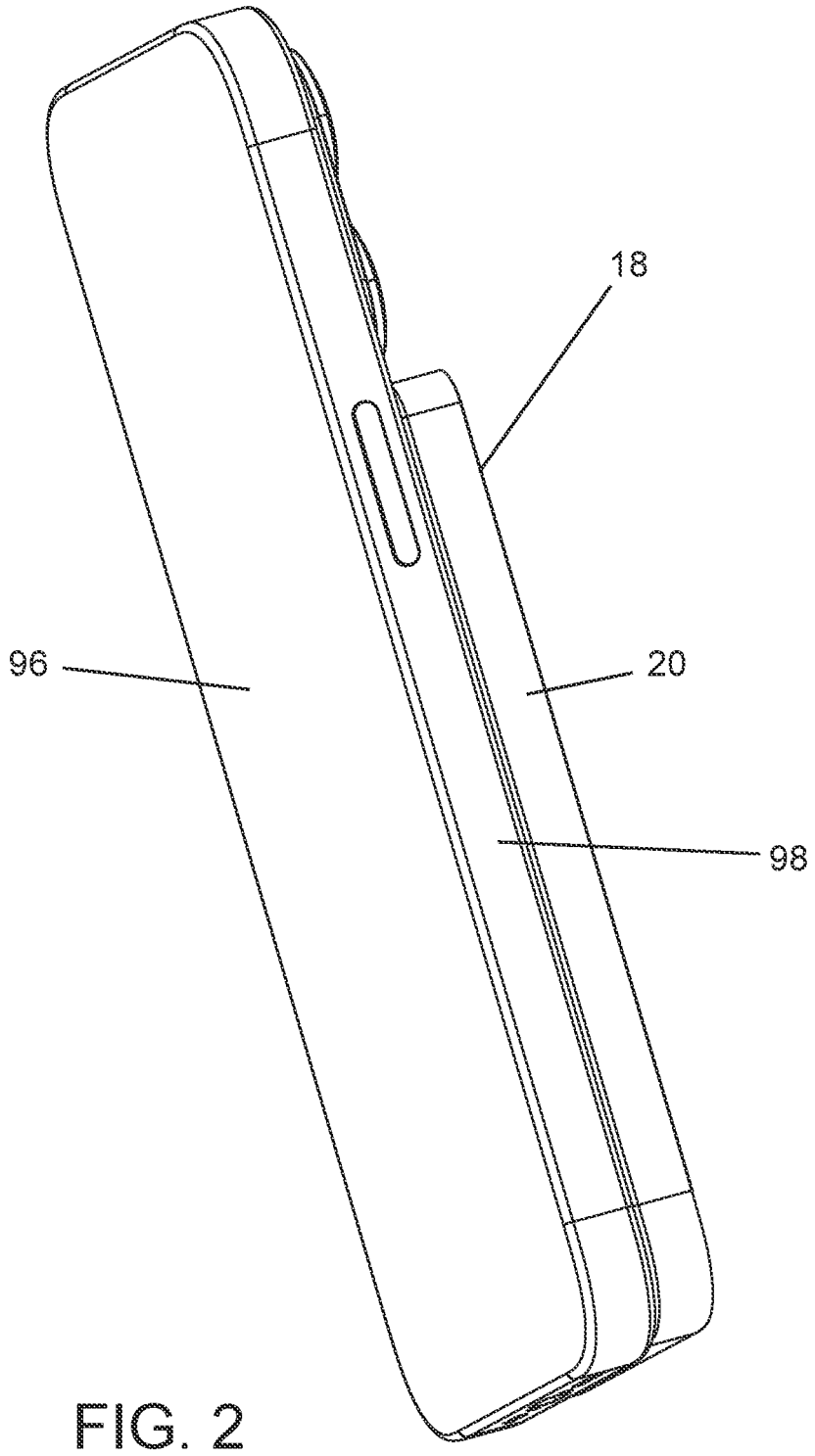
FIG. 2 is a back side perspective view of a detachable phone wallet in according with the present invention and shown magnetically coupled to a smart phone.
Figure 3:
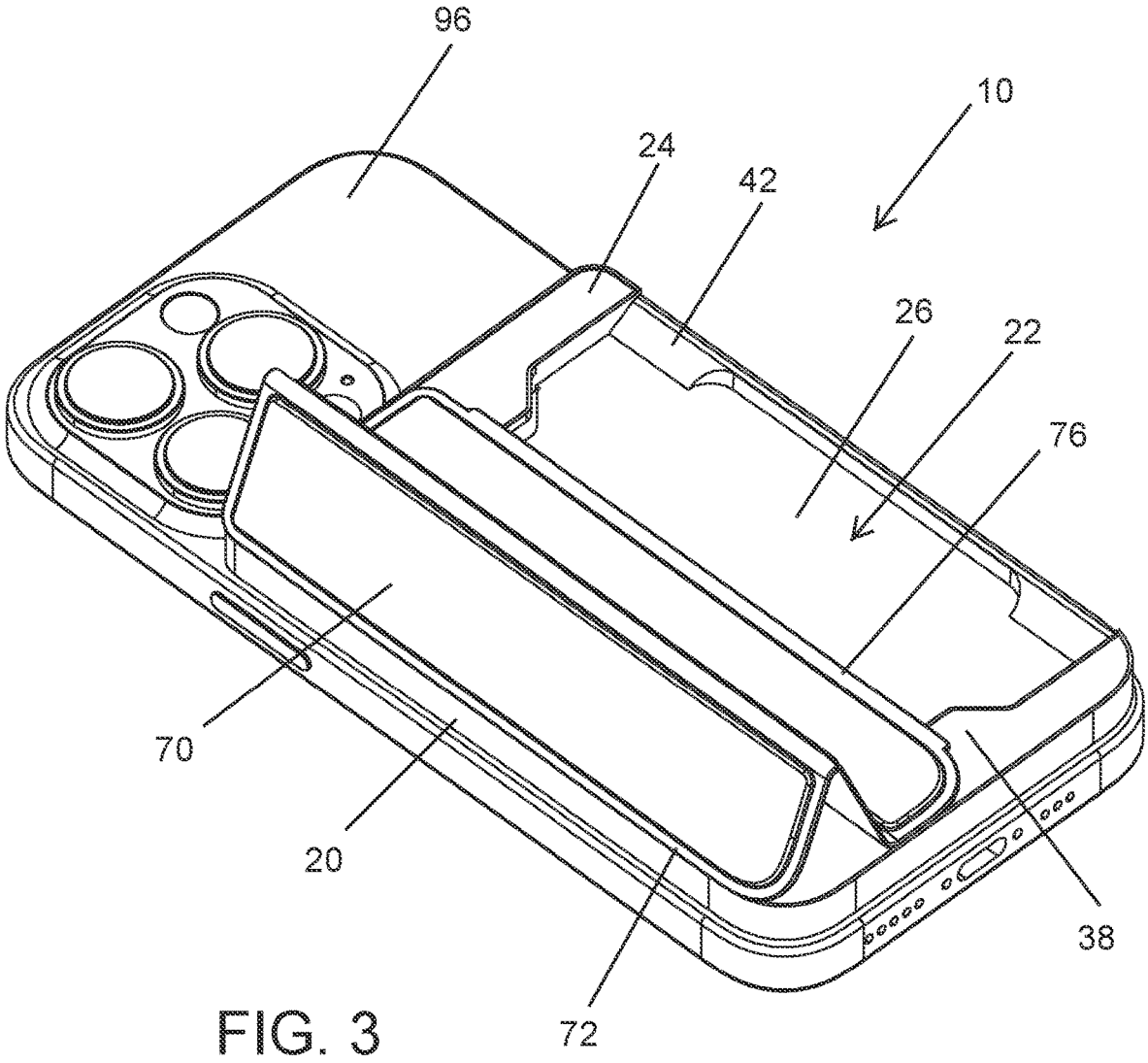
FIG. 3 is a front perspective view of a detachable phone wallet in according with the present invention and shown magnetically coupled to a smart phone.
Figure 4:
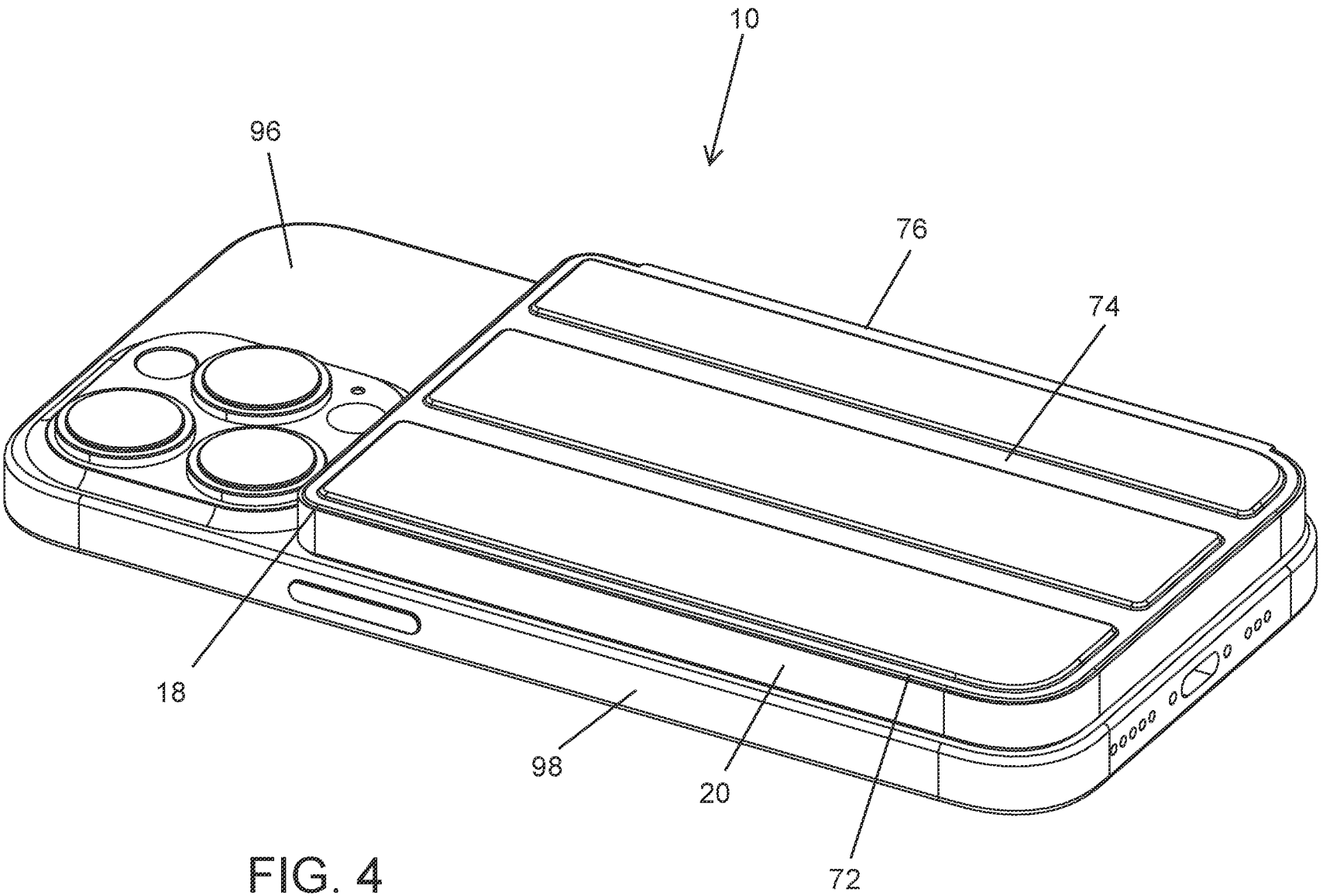
FIG. 4 is a front side perspective view of a detachable phone wallet in according with the present invention and shown magnetically coupled to a smart phone.

With reference to the Figures various aspects of the invention will be further described. FIGS. 1-2 illustrates an exemplary mobile electronic device 96 magnetically coupled with an embodiment of the detachable phone wallet 10 of the present invention. The width between the sides 20 of the detachable phone wallet is dimensioned to be equal to or less than the width between sides 98 of the mobile device 98. The length of the phone wallet is sized such that when it is attached to a mobile device it does not block or interfere with the phone accessories such as camera lens. The thickness is dimensioned to provide storage capacity within the wallet while keeping the overall thickness of the wallet to be relatively thin. In a preferred embodiment the thickness of the wallet 10 is equal to or less than the mobile device 96 to which it attaches.

With reference to FIGS. 3-7 the detachable phone wallet 10 is adhered to the mobile electronic device 96 by means of magnetic attraction. The phone wallet 10 includes a rigid body 18, a panel cover 70, alignment magnets 50 and 52, and panel cover magnets 56. The rigid body 18 has a cavity 22 formed into the rigid body 18 such that the rigid body 18 has an open end or open front 32 and a closed end or closed back side 34. The closed end or back side 34 of the rigid body 18 is comprised of a base portion or layer 26 and a backing portion or outer layer 28. The outer surface 30 or back side of the rigid body 18 contacts the back surface of the phone 96 when magnetically coupled to the phone.

Figure 5:
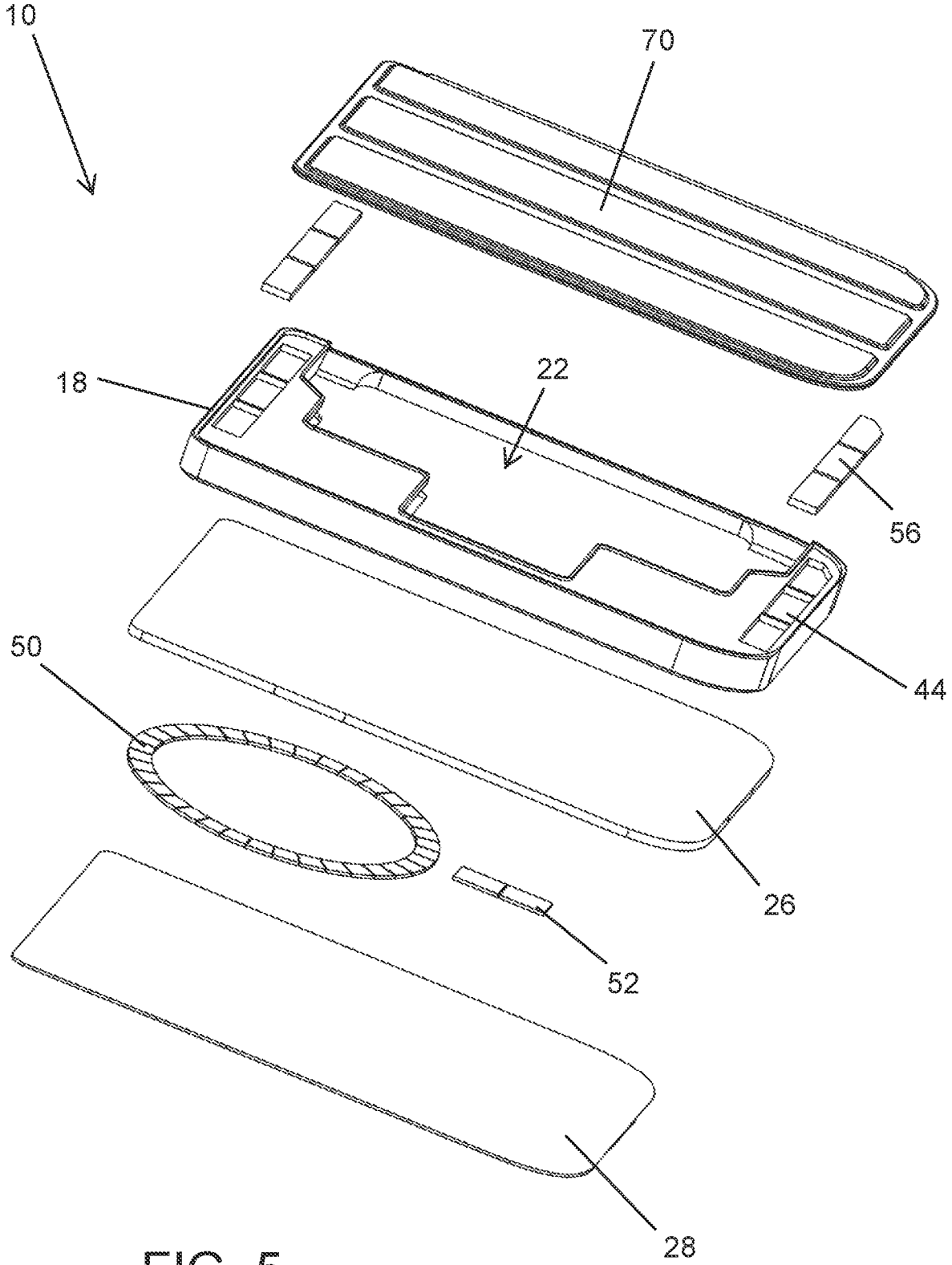
FIG. 5 is a partial exploded perspective view of a detachable phone wallet in accordance with the present invention.
Figure 6:
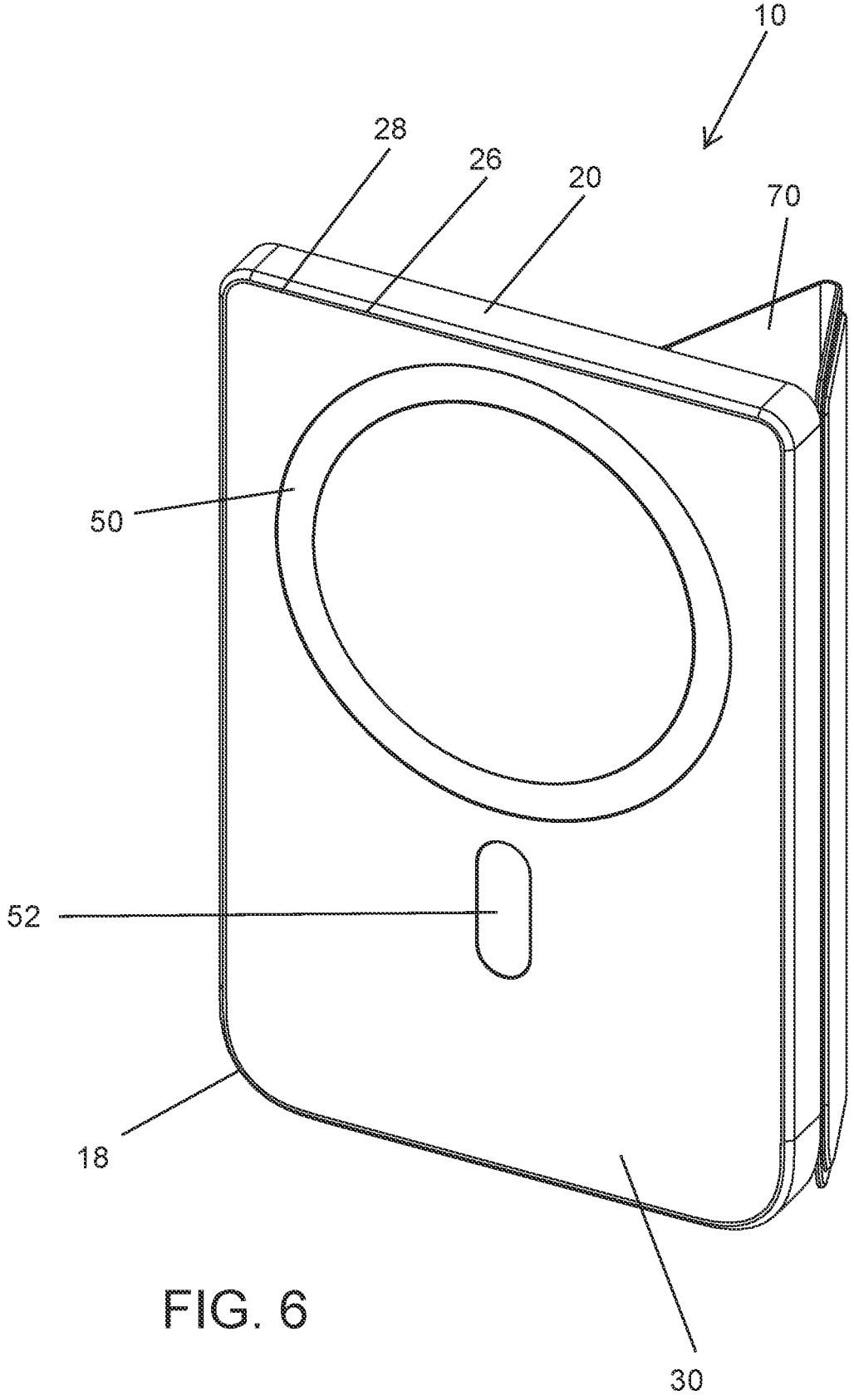
FIG. 6 is a back perspective view of the detachable phone wallet of the type shown in FIG. 5.
Figure 7:
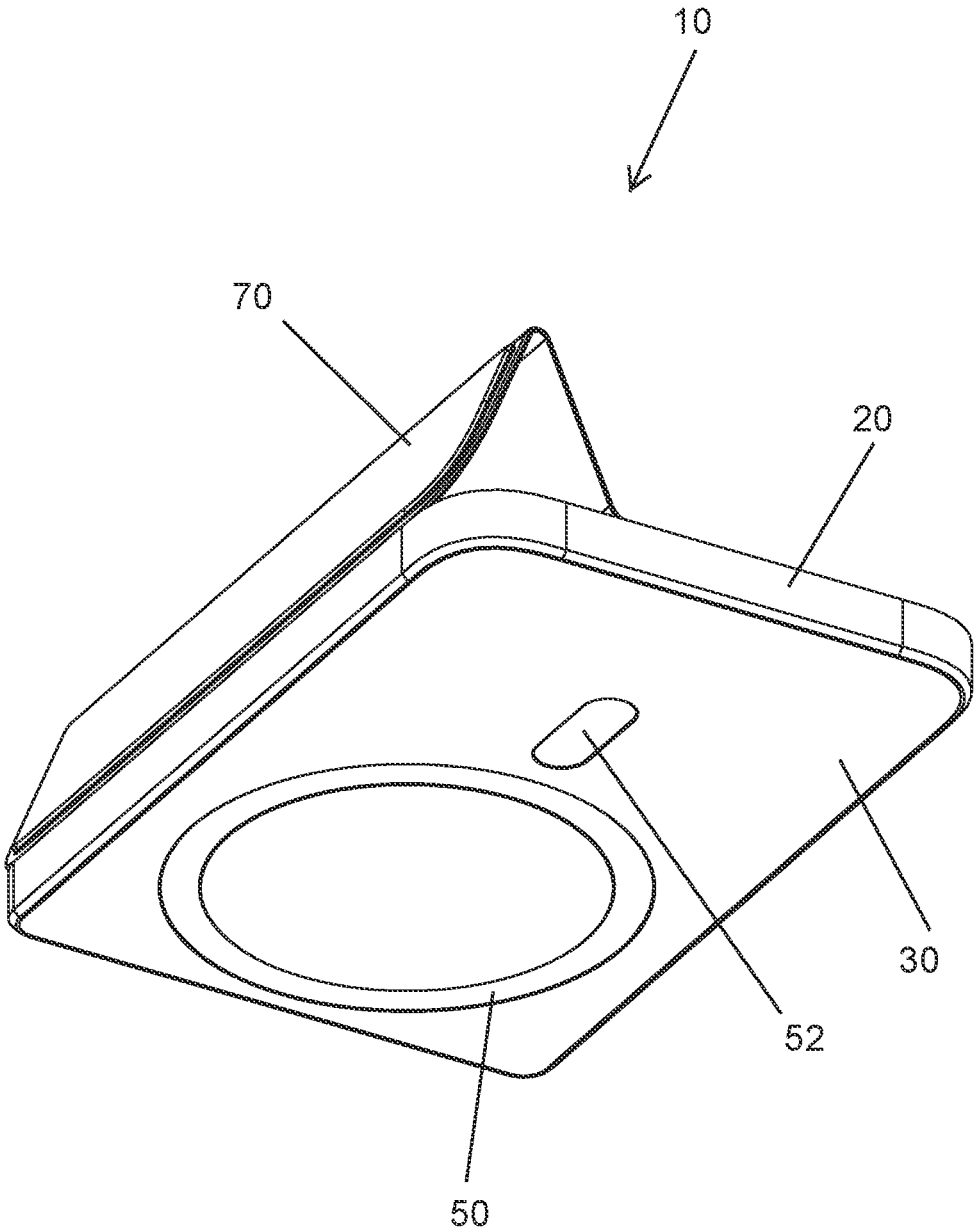
FIG. 7 is a back end perspective view of a detachable phone wallet in accordance with the present invention.

FIGS. 5-7 further illustrates the orientation of the alignment magnets 50 and 52 relative to the rigid body 18. The alignment magnets 50 and 52 are sandwiched between the base portion 26 and backing portion 28 of the rigid body 18. The backing portion 28 forms an exterior of the rigid body 18 is relatively thin such that the strength of the magnetic fields from alignment magnets 50 and 52 are not significantly reduced. Without limitation intended, the backing portion 28 and base portion 26 may be layers or films applied to the rigid body or may be formed integral with the rigid body 18. The hinge panel or panel cover 70 has a first end portion 72 that is fixed to an outer surface 24 of the rigid body 18 and further has a second free end 76 portion that is adapted to extend over and cover the open end 32 of the cavity 22.

Figure 8:
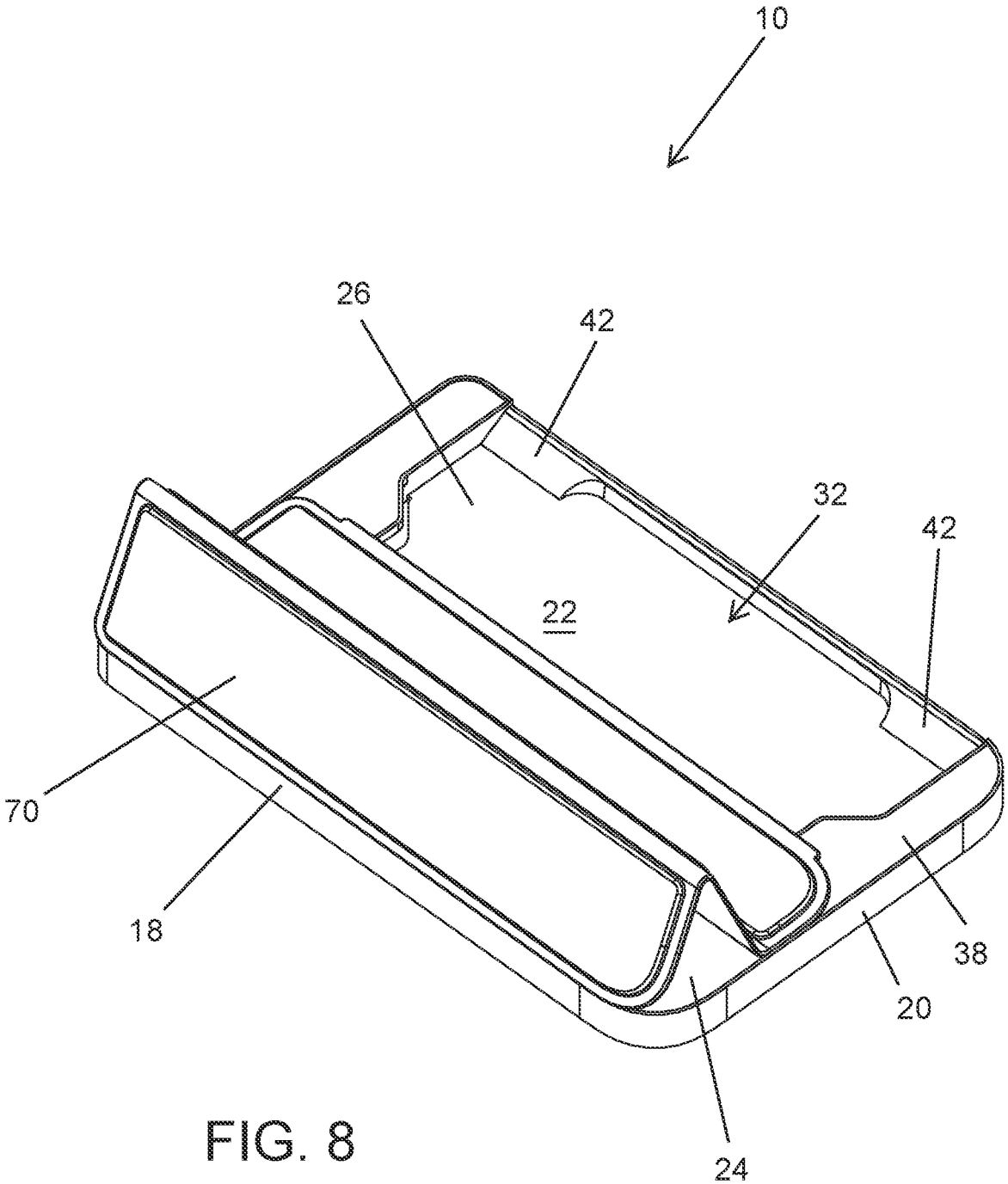
FIG. 8 is a front side perspective view of a detachable phone wallet in accordance with the present invention shown having the hinged panel cover in a partial open or support stand position.
Figure 9:
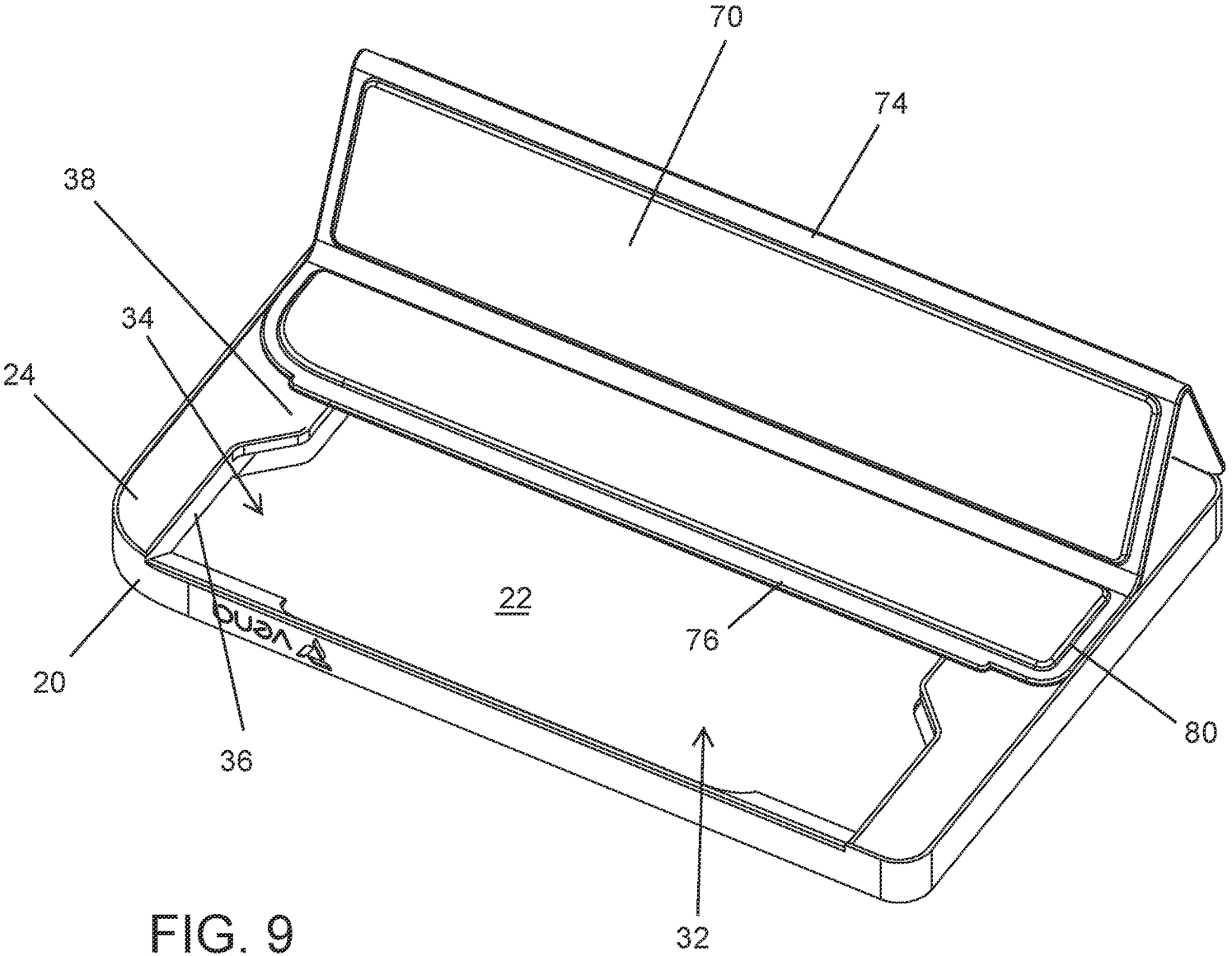
FIG. 9 is a top front perspective view of a detachable phone wallet in accordance with the present invention shown having the hinged panel cover in a partial open or support stand position.
Figure 10:
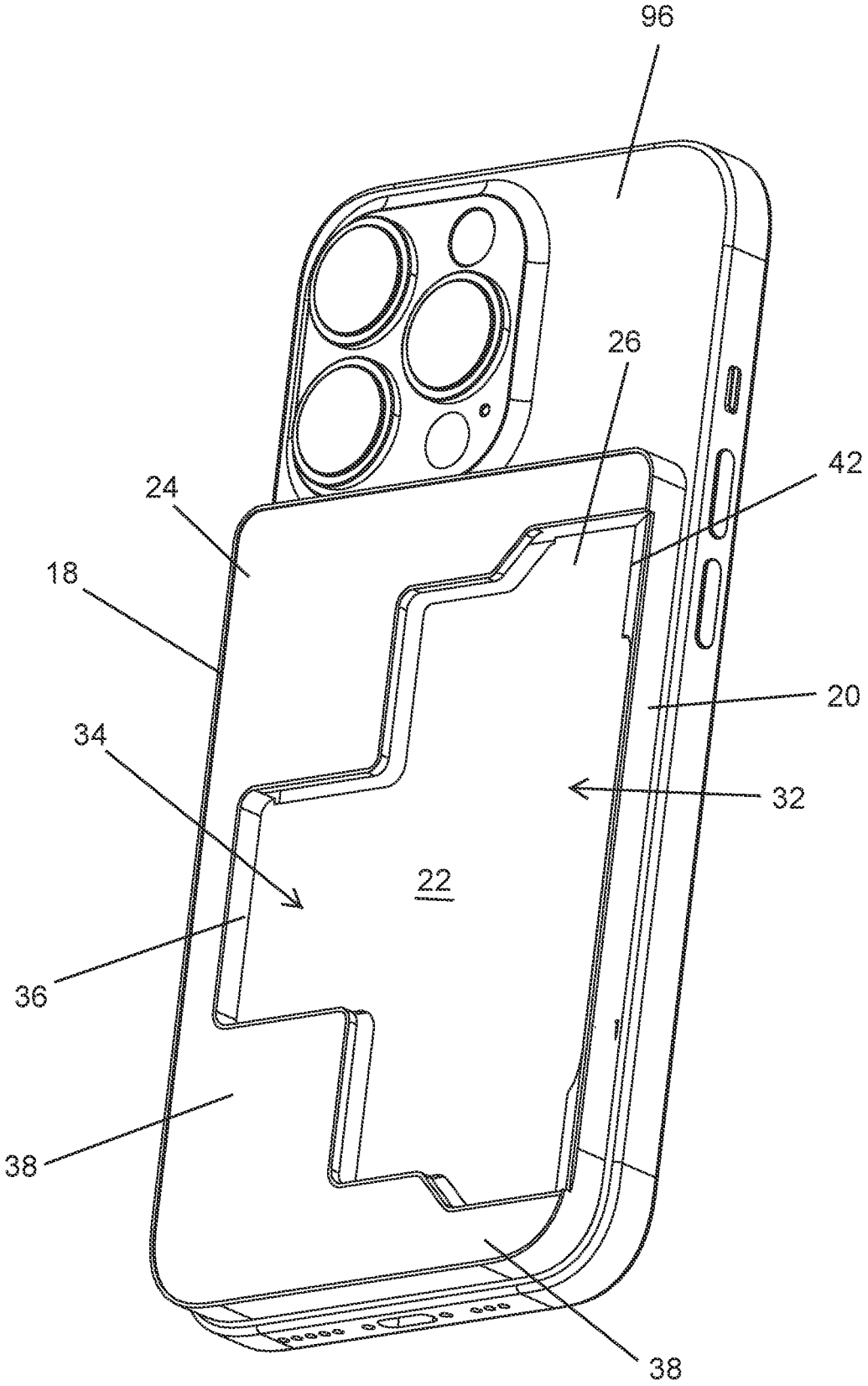
FIG. 10 is a front perspective view of a detachable phone wallet in accordance with the present invention shown having the hinged panel cover removed.

FIGS. 8-10 further illustrates the cavity or compartment 22 formed in the rigid body 18 of the phone wallet 10. The cavity 22 terminates within the rigid body 18 at a base portion 26 of the rigid body, thereby forming the second closed end 34 of the cavity 22. The cavity includes sides 36 that are dimensioned such that the distance between opposing sides is sufficient to allow insertion of an ID or credit card between the sides. A flange 38 extends out and over the cavity 22 to further define the outer surface 24 of the rigid body 18. The flange 38 further supports the hinge panel 70 and retains items placed within the cavity or compartment 22 (see FIG. 10). The front or exposed side of the cavity 22 includes sloped or ramped sides 42. Credit cards or ID's slide up and down the ramp 42 assisting the user to insert and remove cards from the compartment. Pockets 44 are formed in a top surface of the rigid body and are adapted to receive panel magnets 56. The hinge panel 70 includes panel joints 74 and panel sections 80. The panel sections may include metal strips or magnetic strips 80. When the panel is position flat on the outer surface 24 of the rigid body 18, the panel magnets 56 and hinge magnets or metal attract towards each other to help retain the panel cover over the cavity 22 thereby concealing the compartment. The user may further orient the hinge panel 70 to provide a stand for the mobile device 96 (see FIG. 3 and FIGS. 8-9).

Figure 11:
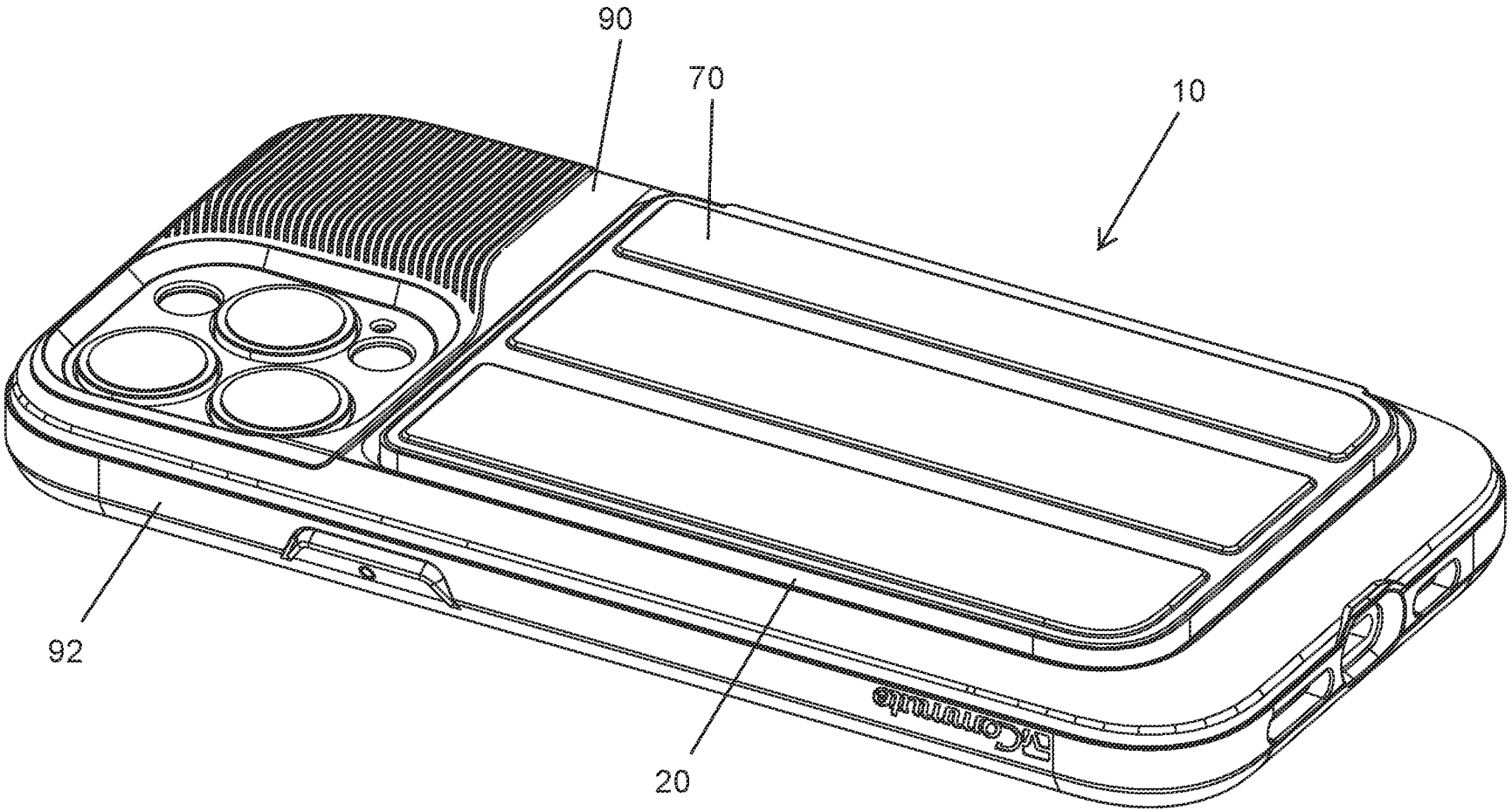
FIG. 11 is a front perspective view of an alternative detachable phone wallet in accordance with the present invention and shown encompassing a portion of a smart phone.
Figure 12:
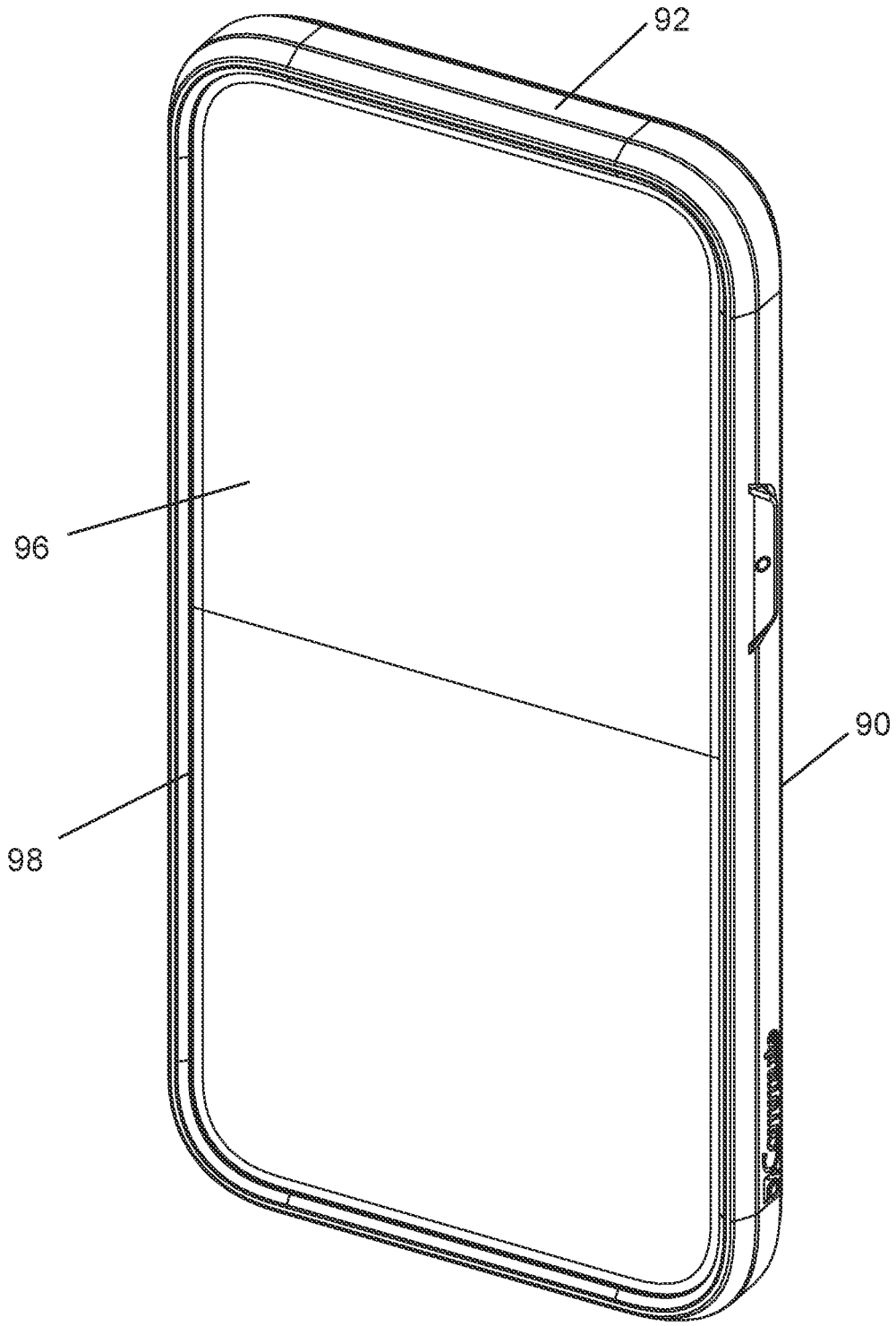
FIG. 12 is a back perspective view of an alternative detachable phone wallet in accordance with the present invention and shown encompassing a portion of a smart phone.

With reference to FIGS. 11-12 another exemplary detachable phone wallet apparatus 10 of the present invention is shown coupled with a mobile electronic device 96. Those skilled in the art will appreciate that the length, width and thickness of the components of detachable wallet 10 may be modified to accommodate various electronic devices including, without limitation intended, various cell phone makes and models, tablets and laptops. The detachable wallet apparatus 10 (illustrated in FIGS. 11-20) generally includes a rigid body 18 and phone casing 84. The phone casing includes a pliable body 86 and a pocket 88 formed in the casing. The pocket includes sidewalls 90 that are adapted for receiving and engaging the rigid body 18. An outer rim portion 92 of the pliable body 86 overlaps at least the sides 98 of the mobile device 96 to retain the mobile device 96.

Figure 13:
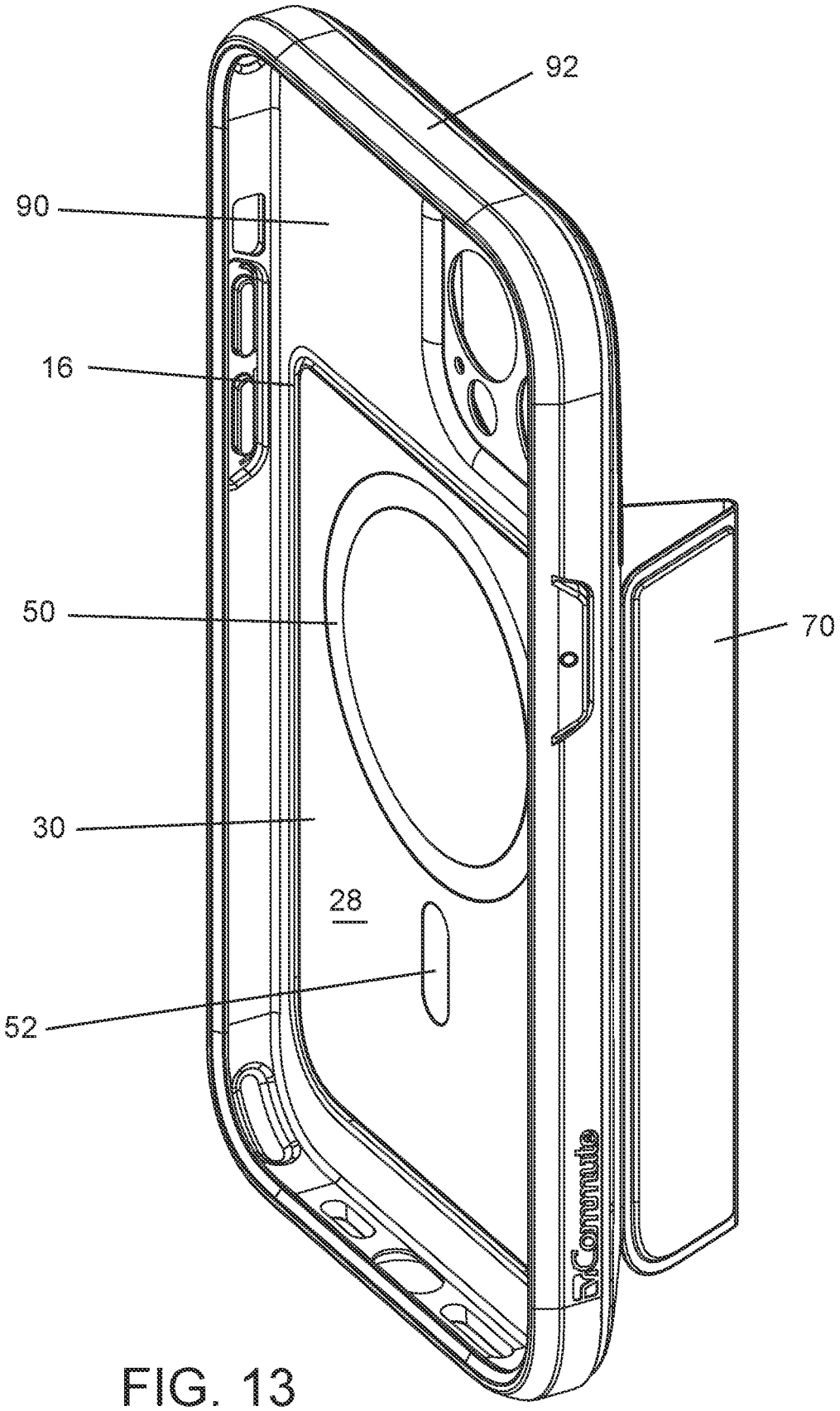
FIG. 13 is a back perspective view of a detachable phone wallet of the type shown in FIG. 12 and shown having the smart phone removed.
Figure 14:
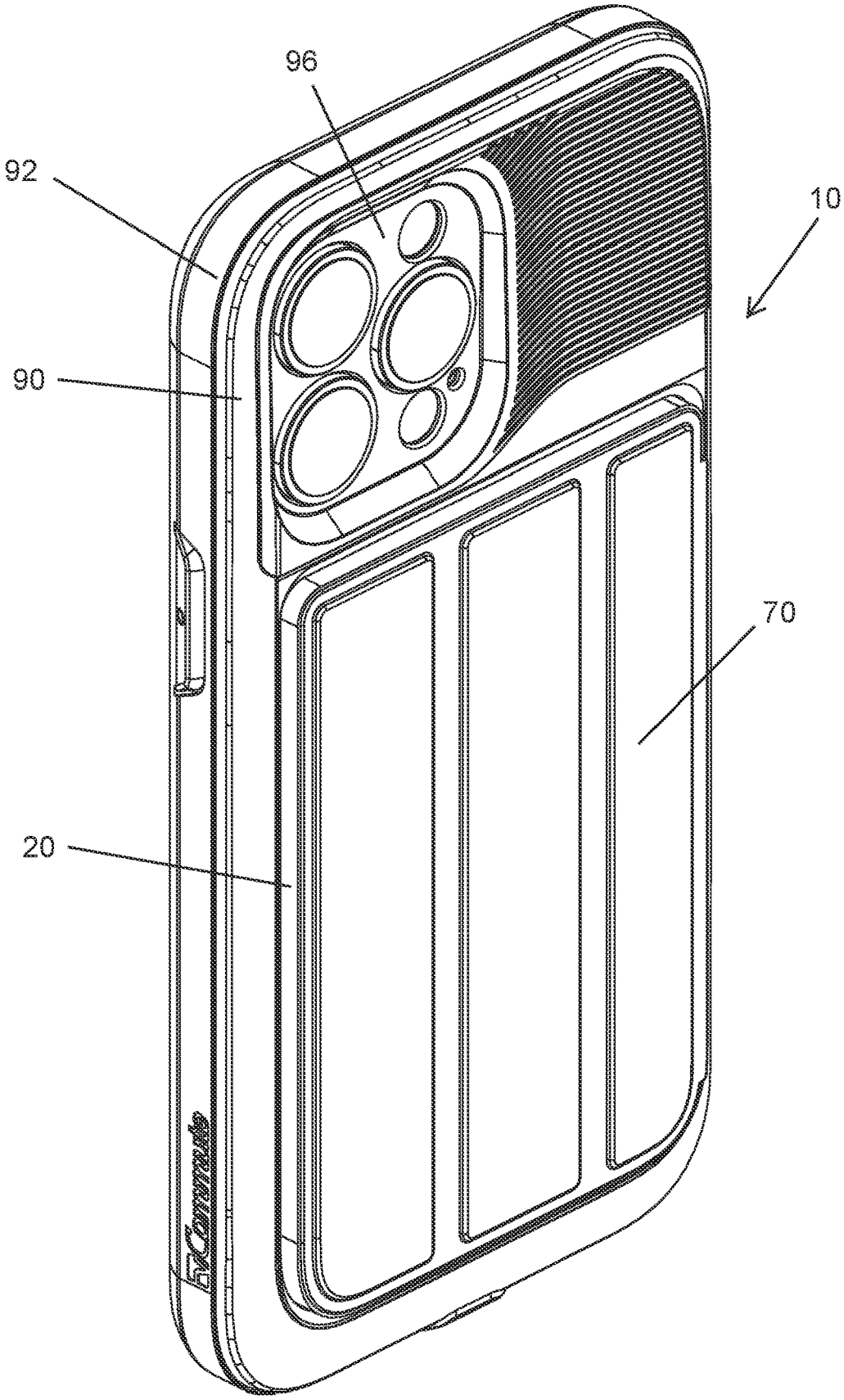
FIG. 14 is a front perspective view of an alternate detachable phone wallet in accordance with the present invention.
Figure 15:
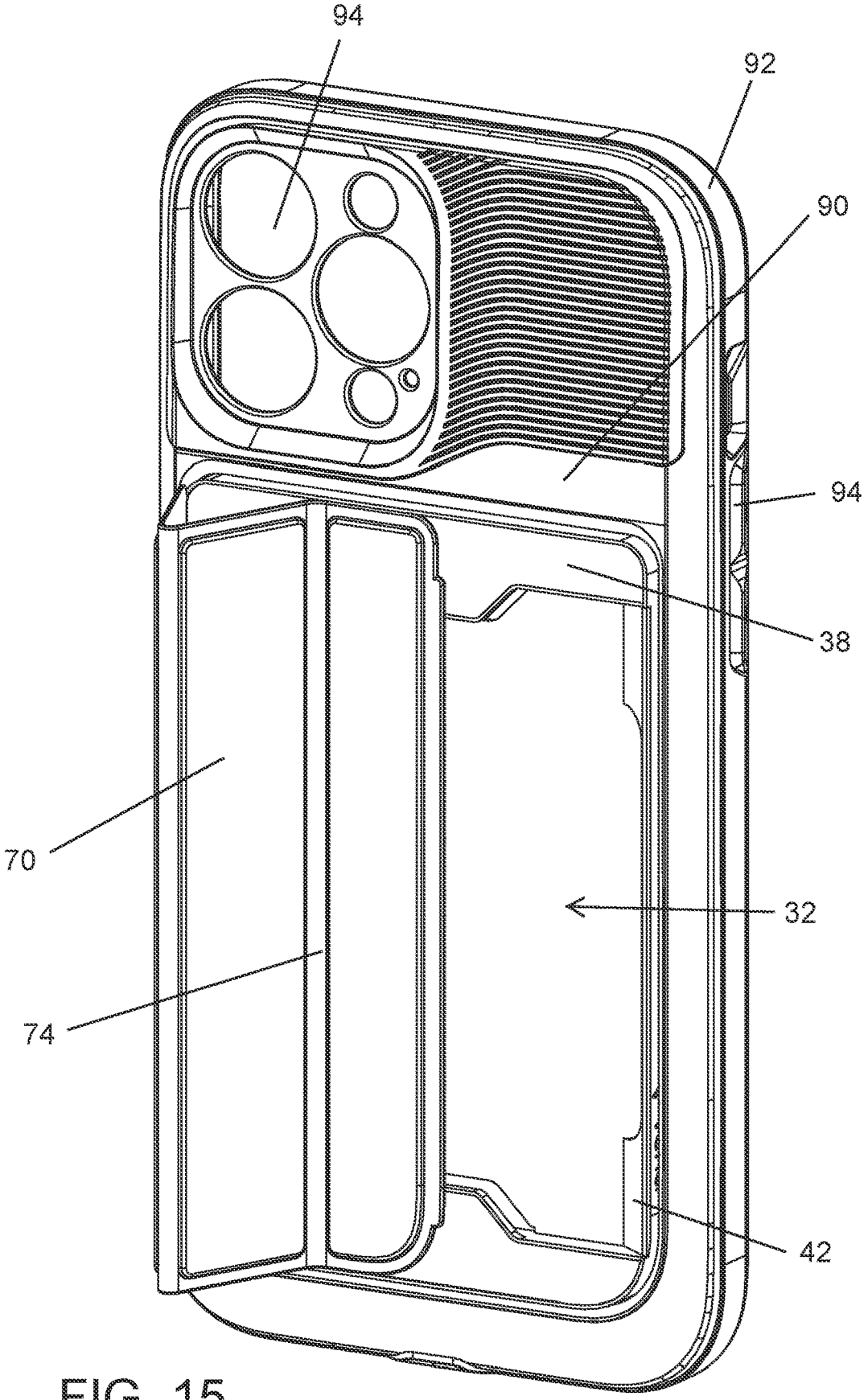
FIG. 15 is a front perspective view of an alternate detachable phone wallet in accordance with the present invention and shown having the hinged panel cover in a partial open or support stand position.
Figure 16:
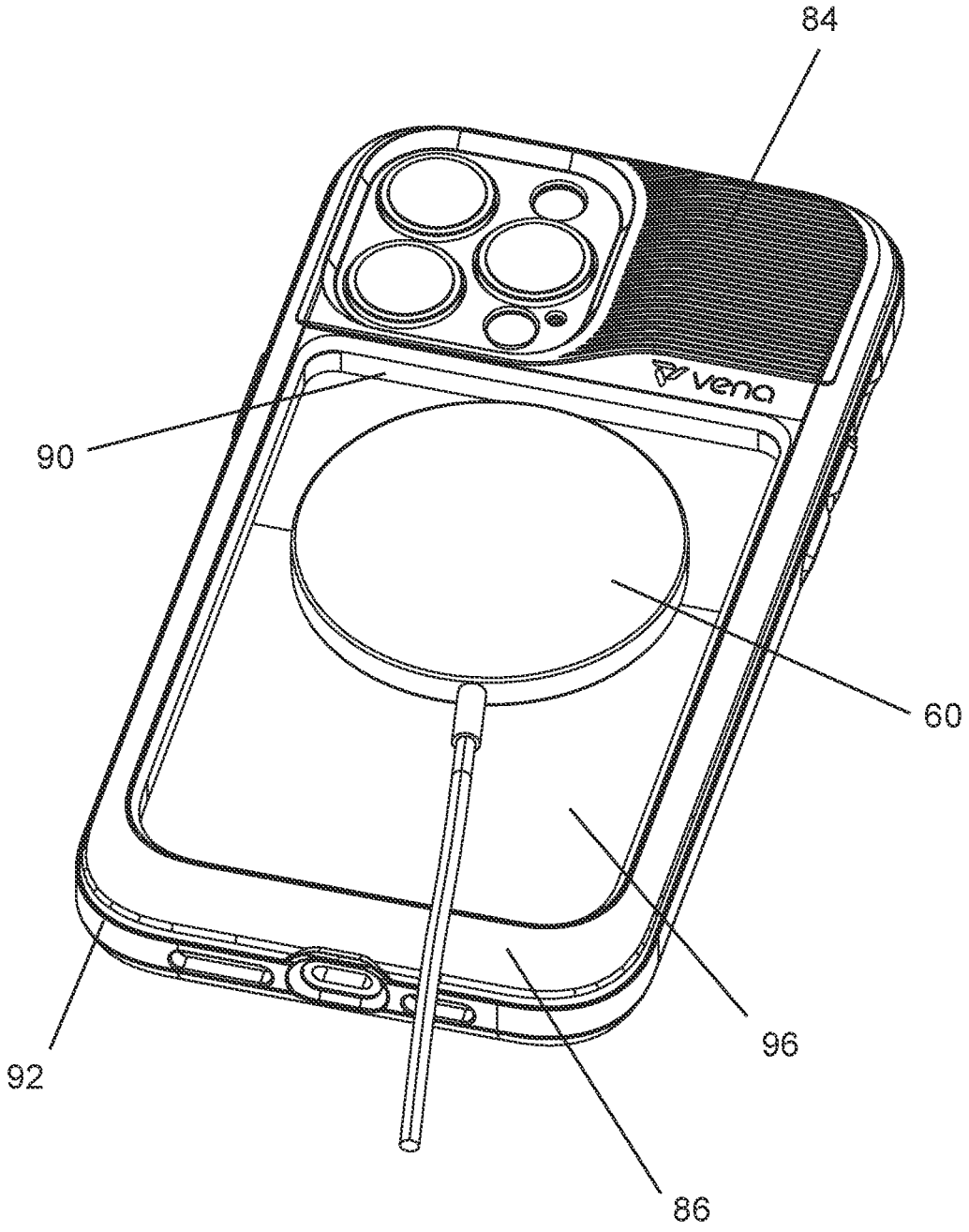
FIG. 16 is a perspective view of a phone casing in accordance with the present invention shown having the detachable phone wallet removed from the phone casing pocket and having a wireless charger aligned and engaged with a phone contained within the casing.
Figure 17:
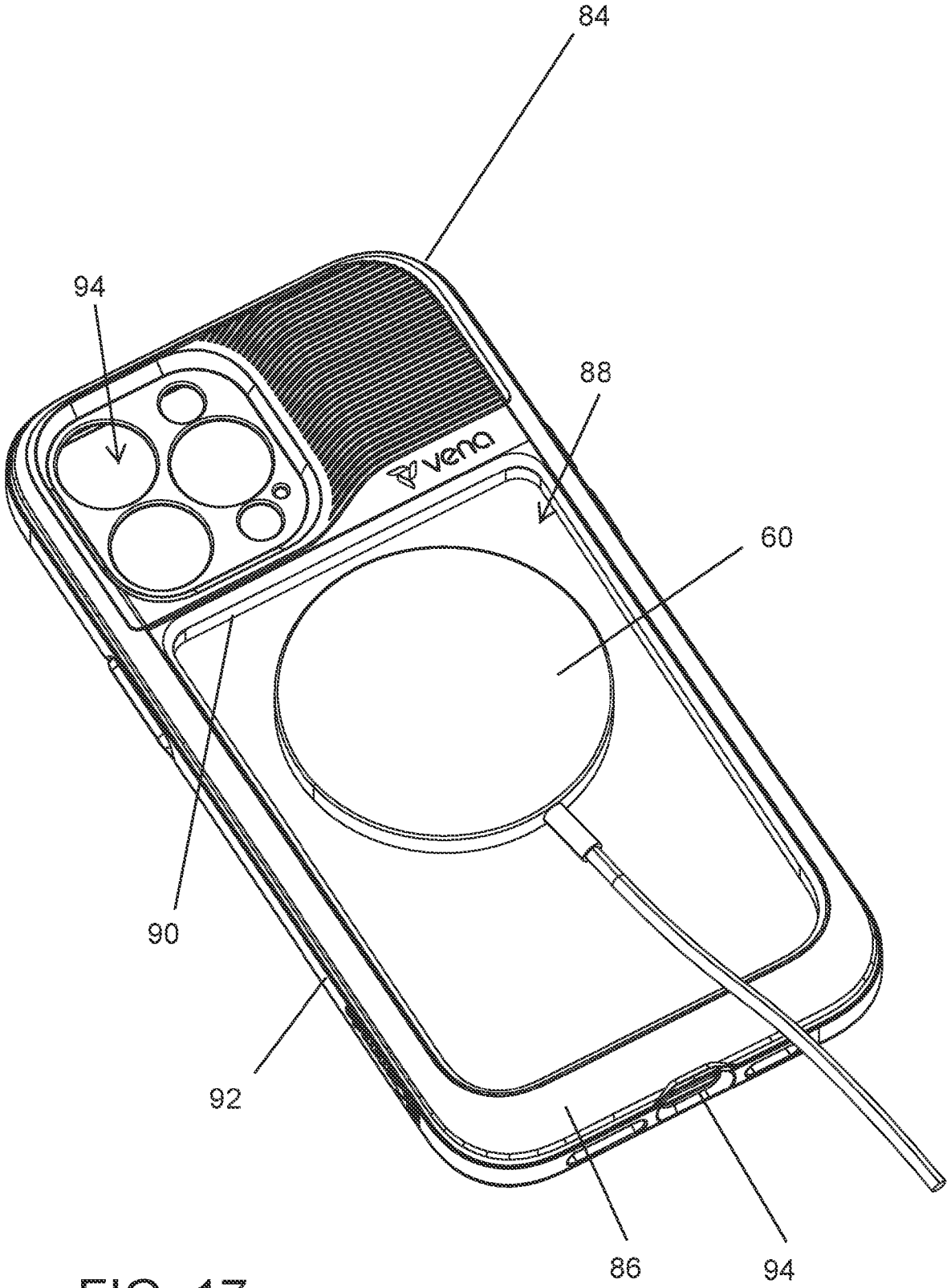
FIG. 17 is a perspective view of a phone casing in accordance with the present invention shown having the detachable phone wallet removed from the phone casing pocket and having a wireless charger aligned within the pocket of the casing.
Figure 18:
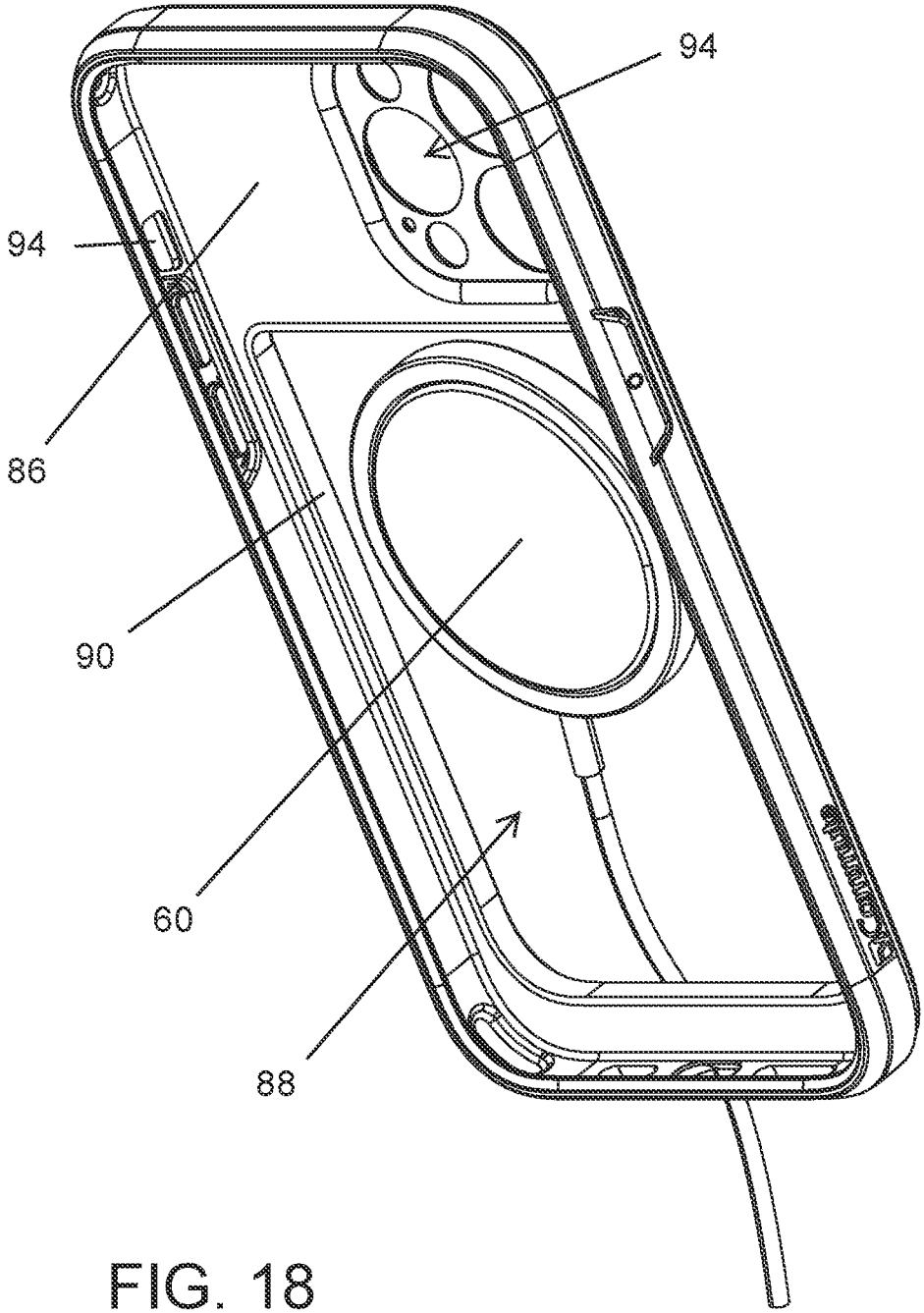
FIG. 18 is a back perspective view of a phone casing in accordance with the present invention shown having the detachable phone wallet removed from the phone casing pocket and having a wireless charger aligned within the pocket of the casing.
Figure 19:
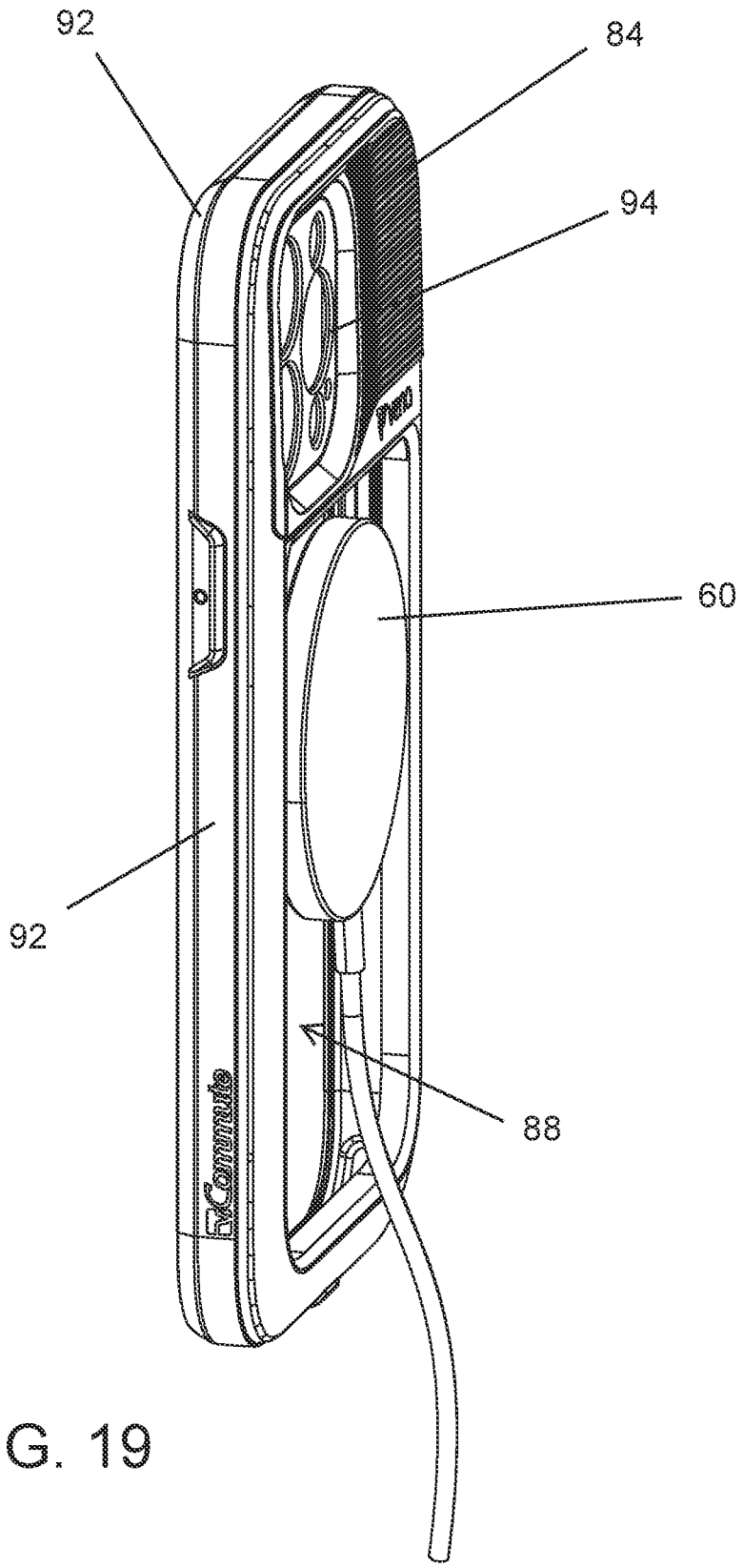
FIG. 19 is a left side perspective view of a phone casing in accordance with the present invention shown having the detachable phone wallet removed from the phone casing pocket and having a wireless charger aligned within the pocket of the casing.
Figure 20:
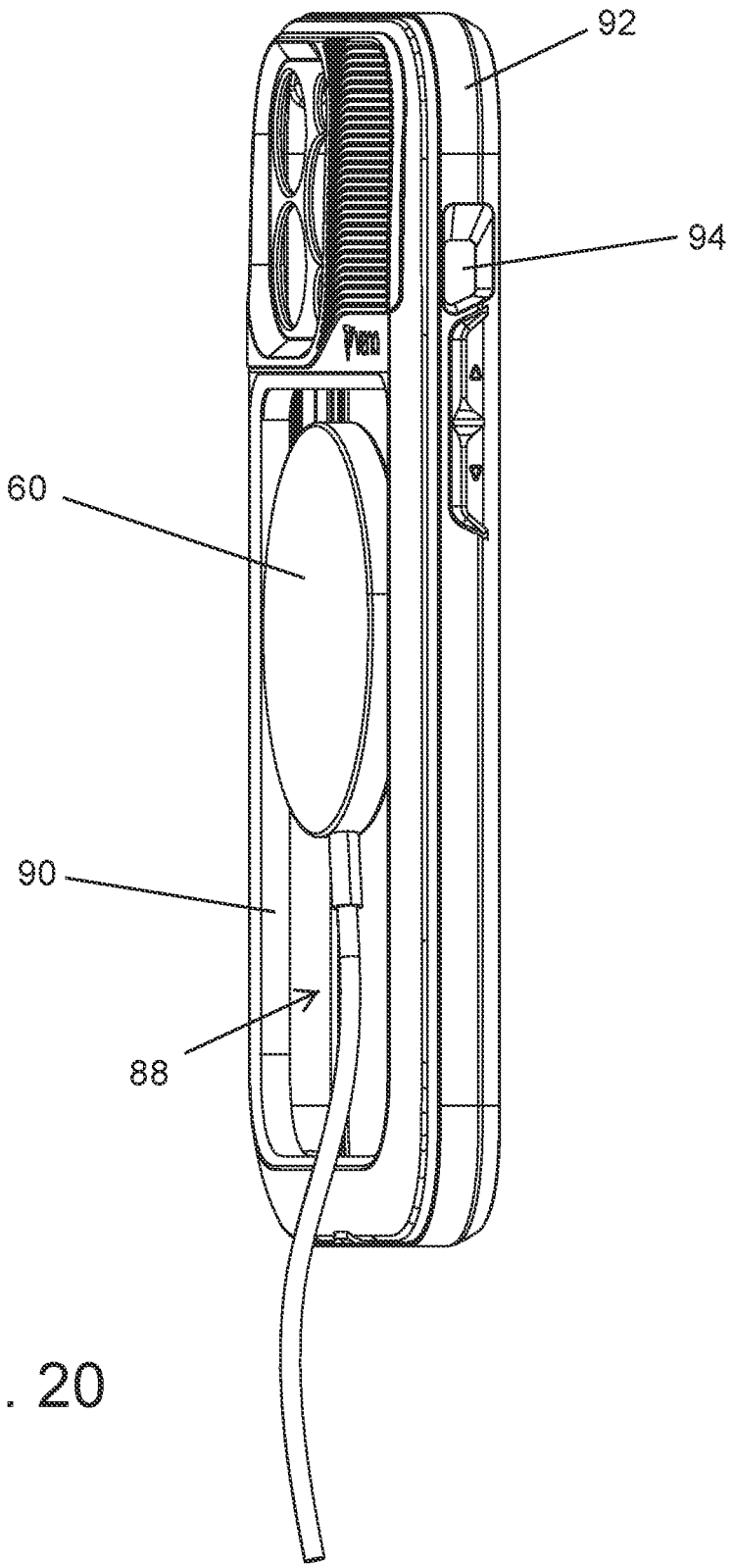
FIG. 20 is a right side perspective view of a phone casing in accordance with the present invention shown having the detachable phone wallet removed from the phone casing pocket and having a wireless charger aligned within the pocket of the casing.

FIGS. 13-15 further illustrates how the casing 84 and rigid body 18 integrate together to provide a phone wallet that may also act as a protective casing for a phone. The pliable body 86 of the protective phone casing 84 extends outward from the pocket 88 in the same plane as the back face of the rigid body 18 and includes a rim 92 extending orthogonally about a perimeter of the pliable body. The dimensions of the planar casing 84 and rim 92 are such so that sides of a phone may be encompassed, engaged, and encased by the rim 92. Without limitation intended, the casing 84 is pliable in the sense that the rim 92 may be deformed or bent to slip over the sides of a phone and encase the phone sides. Apertures 94 may extend through various locations about the casing 84, pliable body 86, and rim 92. The apertures 94 align with and correspond with various features of the electronic device.

The rigid body 18 has a cavity 22 formed into the rigid body 18 such that the rigid body 18 has an open end or open front 32 and a closed end or closed back side 34. The closed end or back side 34 of the rigid body 18 is comprised of a base portion or layer 26 and a backing portion or outer layer 28. The outer surface 30 or back side of the rigid body 18 contacts the back surface of the phone 96 when magnetically coupled to the phone. FIG. 13 illustrates the orientation of the alignment magnets 50 and 52 relative to the rigid body 18. The alignment magnets 50 and 52 are sandwiched between the base portion 26 and backing portion 28 of the rigid body 18. The backing portion 28 forms an exterior of the rigid body 18 is relatively thin such that the strength of the magnetic fields from alignment magnets 50 and 52 are not significantly reduced. Without limitation intended, the backing portion 28 and base portion 26 may be layers or films applied to the rigid body or may be formed integral with the rigid body 18. The hinge panel or panel cover 70 has a first end portion 72 that is fixed to an outer surface 24 of the rigid body 18 and further has a second free end 76 portion that is adapted to extend over and cover the open end 32 of the cavity 22.

FIG. 15 further illustrates the cavity or compartment 22 formed in the rigid body 18 of the phone wallet 10. The cavity 22 terminates within the rigid body 18 at a base portion 26 of the rigid body, thereby forming the second closed end 34 of the cavity 22. The cavity includes sides 36 that are dimensioned such that the distance between opposing sides is sufficient to allow insertion of an ID or credit card between the sides. A flange 38 extends out and over the cavity 22 to further define the outer surface 24 of the rigid body 18. The flange 38 further supports the hinge panel 70 and retains items placed within the cavity or compartment 22. Various configurations of the flange may be provided dependent upon the amount of cavity exposure desired. The front or exposed side of the cavity 22 includes sloped or ramped sides 42. Credit cards or ID's slide up and down the ramp 42 assisting the user to insert and remove cards from the compartment. Pockets 44 are formed in a top surface of the rigid body and are adapted to receive panel magnets 56.

The hinge panel 70 includes panel joints 74 and panel sections 80. The panel sections may include metal strips or magnetic strips 80. When the panel is positioned flat on the outer surface 24 of the rigid body 18, the panel magnets 56 and hinge magnets or metal attract towards each other to help retain the panel cover over the cavity 22 thereby concealing the compartment. The metal strips or magnets cooperate with magnets 56 to fix the panel in a desired position relative to rigid body 18. Those skilled in the art will appreciate the panel 70 may be formed integral with the rigid body 18, may be permanently attached to the rigid body 18 or may be removably attached to the rigid body 18. The hinged panel cover 70 may be oriented in several positions relative to the rigid body. By way of example the hinged panel 70 may be utilized to vary the angle of the display screen of the mobile device 96 when propped on a flat surface. The user may use the length of the panel or an end of the panel to prop the phone. Depending upon whether the user chooses to rest the length or end against the flat surface, the viewing angle may range from 15-45 degrees from vertical or from 20-25 degrees from a horizontal viewing angle.

FIGS. 16-20 further illustrates the casing 84 integrated with the rigid body 18 and the ability to wirelessly charge the batteries of the electronic device 96 without decoupling or removing the casing 84 from the electronic device. The casing 84 includes a planar pliable body 86. A pocket 88 is formed in the casing wherein the pocket has an inner sidewall 90 that is sized slightly larger than the perimeter of the rigid body. The rigid body nests within the pocket of the casing 84 and the magnets fix the rigid body within the pocket. To wirelessly charge the device the user simply removes the rigid body to expose the back side of the phone 96. The user then places charger 60 in contact with the phone 96. The alignment magnets 50 and 52 of the rigid body retain the rigid body and keep it from falling out of the pocket 88 formed in the casing 84.

The various embodiments described herein are illustrative of the present invention and not limiting as to the scope and spirit of the present invention. These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open-ended sense in that elements in addition to those enumerated may also be present. Other examples will be apparent to those of skill in the art upon reviewing this document.

What is claimed is:

1. A detachable phone wallet apparatus for coupling to an electronic device, the phone wallet apparatus comprising:

a rigid body having outer perimeter sidewalls and a cavity formed therein, the cavity having an open end, a closed end and opposing sidewalls extending between the open end and closed end;

a hinged panel having a first end portion fixed to an outer surface of the rigid body and a second free end portion that is adapted to extend over and cover the open end of the cavity;

a base portion of the rigid body forming the closed end of the cavity;

a backing portion of the base portion of the rigid body, wherein the backing portion forms an exterior of the rigid body;

alignment magnets sandwiched between the base portion and backing portion of the rigid body;

panel magnets associated with one of the hinged panel and the rigid body;

wherein the hinged panel includes a plurality of hinged folds; and a casing having a pliable body, the pliable body having a rim extending about a perimeter of the pliable body, wherein the rim of the pliable body is adapted for engaging sides of an electronic device, and further having a pocket extending though the pliable body wherein the pocket is adapted for retaining the outer perimeter sidewalls of the rigid body and for receiving the rigid body therein.

2. The phone wallet apparatus as recited in claim 1, further including metal strips associated with the hinged panel.

3. The phone wallet apparatus as recited in claim 1, wherein the hinged folds are defined by a plurality of hinged joints.

4. The phone wallet apparatus as recited in claim 1, further including flanges blocking outer access to a portion of the cavity.

5. The phone wallet apparatus as recited in claim 4, further including a ramped side of the cavity.

6. The phone wallet apparatus as recited in claim 1, wherein the casing further includes apertures extending through the pliable body and oriented to align with features of the electronic device.

7. A detachable phone wallet apparatus for coupling to an electronic device, the phone wallet apparatus comprising:

a rigid body having a cavity formed therein;

a hinged panel having a first end portion fixed to an outer surface of the rigid body and a second free end portion that is adapted to extend over and cover a first open end of the cavity;

a base portion of the rigid body forming a second closed end of the cavity;

flanges blocking outer access to a portion of the cavity;

a backing portion of the base portion of the rigid body, wherein the backing portion forms an exterior of the rigid body;

alignment magnets sandwiched between the base portion and backing portion of the rigid body;

panel magnets associated with one of the hinged panel and the rigid body;

wherein the hinged panel includes a plurality of hinged folds; and a casing having a pliable body, the pliable body having a rim extending about a perimeter of the pliable body, wherein the rim of the pliable body is adapted for engaging sides of an electronic device, and further having a pocket extending through the pliable body wherein the pocket is adapted for receiving the rigid body therein.

8. The phone wallet apparatus as recited in claim 7, further including metal strips associated with the hinged panel.

9. The phone wallet apparatus as recited in claim 7, wherein the hinged folds are defined by a plurality of hinged joints.

10. The phone wallet apparatus as recited in claim 9, further including a ramped side of the cavity.

11. The phone wallet apparatus as recited in claim 10, wherein the ramped side is formed on at least one of the base portion or opposing inner sides of the cavity.

12. The phone wallet apparatus as recited in claim 7, wherein the casing further includes apertures extending through the pliable body and oriented to align with features of the electronic device.

13. A detachable phone wallet apparatus for coupling to an electronic device, the phone wallet apparatus comprising:

a rigid body having outer perimeter sidewalls and a cavity formed in the rigid body, the cavity having an open end, a closed end and opposing interior sidewalls extending between the open end and closed end, wherein the closed end of the rigid body is comprised of a base portion and a backing portion, wherein the backing portion forms an exterior back portion of the rigid body;

a casing having a pliable body, the pliable body having a rim extending about a perimeter of the pliable body, wherein the rim of the pliable body is adapted for engaging sides of an electronic device, and further wherein the casing has a pocket extending through the pliable body wherein the pocket is sized and adapted for receiving the rigid body therein, wherein the rigid body may be inserted and removed from the pocket without removing the casing from engagement with the electronic device;

a hinged panel having a first end portion fixed to an outer surface of the rigid body wherein the outer surface opposes the exterior back portion of the rigid body and the hinged panel further having a second free end portion that is adapted to extend over and cover the open end of the cavity;

alignment magnets sandwiched between the base portion and backing portion of the rigid body;

panel magnets associated with one of the hinged panel and the rigid body; and wherein the hinged panel includes a plurality of hinged folds.

14. The phone wallet apparatus as recited in claim 13, further including metal strips associated with the hinged panel.

15. The phone wallet apparatus as recited in claim 13, wherein the hinged folds are defined by a plurality of hinged joints.

16. The phone wallet apparatus as recited in claim 13, further including flanges blocking outer access to a portion of the cavity.

17. The phone wallet apparatus as recited in claim 16, further including a ramped side of the cavity.

18. The phone wallet apparatus as recited in claim 13, wherein the casing further includes apertures extending through the pliable body and oriented to align with features of the electronic device.

* * * * *